US008500573B2

(12) United States Patent
Rick

(10) Patent No.: US 8,500,573 B2
(45) **Date of Patent: *Aug. 6, 2013**

(54) HARDENED GOLF CLUB HEAD

(75) Inventor: Helene Rick, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/307,324

(22) Filed: Nov. 30, 2011

(65) Prior Publication Data

US 2012/0088600 A1 Apr. 12, 2012

Related U.S. Application Data

(63) Continuation of application No. 12/490,666, filed on Jun. 24, 2009, now Pat. No. 8,075,420.

(51) Int. Cl.
*A63B 53/04* (2006.01)

(52) U.S. Cl.
USPC ..... 473/342; 473/349; 473/350

(58) Field of Classification Search
USPC ..... 473/324–350
See application file for complete search history.

(56) References Cited

U.S. PATENT DOCUMENTS

| | | | | | |
|---|---|---|---|---|---|
| 3,658,514 | A | * | 4/1972 | Lula et al. | 420/70 |
| 3,696,486 | A | * | 10/1972 | Benjamin | 75/230 |
| 3,811,929 | A | * | 5/1974 | Kanetake | 148/220 |
| 3,840,366 | A | * | 10/1974 | Hirayama et al. | 148/326 |
| 3,869,318 | A | * | 3/1975 | Hellman et al. | 148/621 |
| 4,033,789 | A | * | 7/1977 | Hamburg et al. | 148/503 |
| 4,082,577 | A | * | 4/1978 | Heller | 148/581 |
| 4,154,629 | A | * | 5/1979 | Asai et al. | 148/232 |
| 4,314,863 | A | * | 2/1982 | McCormick | 420/61 |
| 4,386,972 | A | * | 6/1983 | Knight | 148/218 |
| 4,472,209 | A | * | 9/1984 | Langerich et al. | 148/216 |
| 4,768,787 | A | | 9/1988 | Shira | |
| 4,881,991 | A | * | 11/1989 | Beeton et al. | 148/325 |
| 5,062,638 | A | * | 11/1991 | Shira | 473/350 |
| 5,083,778 | A | * | 1/1992 | Douglass | 473/329 |
| 5,089,067 | A | * | 2/1992 | Schumacher | 148/325 |
| 5,094,383 | A | * | 3/1992 | Anderson et al. | 228/176 |
| 5,176,384 | A | * | 1/1993 | Sata et al. | 473/329 |
| 5,370,750 | A | * | 12/1994 | Novotny et al. | 148/325 |
| 5,433,798 | A | * | 7/1995 | Takano et al. | 148/325 |
| 5,569,337 | A | * | 10/1996 | Yoshida et al. | 148/325 |
| 5,584,770 | A | * | 12/1996 | Jensen | 473/350 |
| 5,601,501 | A | * | 2/1997 | Kobayashi | 473/350 |
| 5,630,888 | A | | 5/1997 | Yoshida et al. | |
| 5,658,209 | A | * | 8/1997 | Blakemore | 473/350 |
| 5,714,114 | A | * | 2/1998 | Uehara | 420/61 |

(Continued)

FOREIGN PATENT DOCUMENTS

| | | | | |
|---|---|---|---|---|
| JP | 57079168 | A | * | 5/1982 |
| JP | 61253347 | A | * | 11/1986 |

(Continued)

*Primary Examiner* — Alvin Hunter
(74) *Attorney, Agent, or Firm* — Randy K. Chang

(57) ABSTRACT

A golf club head with a hardened striking face portion that improves durability and performance is disclosed. More specifically, the golf club head disclosed may have a martensitic striking face portion that may be at least about 1.3 times harder than the rear portion of the golf club head due to the martensitic crystalline structure of the striking face portion foamed by heating and quenching the striking face portion of the golf club head.

14 Claims, 8 Drawing Sheets

U.S. PATENT DOCUMENTS

| | | | | |
|---|---|---|---|---|
| 5,755,626 | A * | 5/1998 | Shira | 473/330 |
| 5,792,004 | A * | 8/1998 | Nagamoto | 473/349 |
| 5,807,190 | A | 9/1998 | Krumme et al. | |
| 5,944,916 | A * | 8/1999 | Chung | 148/229 |
| 6,096,262 | A * | 8/2000 | Ueta et al. | 420/67 |
| 6,334,817 | B1 * | 1/2002 | Ezawa et al. | 473/324 |
| 6,481,088 | B1 * | 11/2002 | Inoue et al. | 29/527.5 |
| 6,488,786 | B2 * | 12/2002 | Hiramatsu et al. | 148/325 |
| 6,494,789 | B2 * | 12/2002 | Chen | 473/324 |
| 6,530,998 | B1 * | 3/2003 | Oofune | 148/238 |
| 6,562,153 | B1 * | 5/2003 | Uehara et al. | 148/325 |
| 6,660,105 | B1 * | 12/2003 | Ochi et al. | 148/320 |
| 6,793,744 | B1 * | 9/2004 | Jung | 148/325 |
| 6,832,961 | B2 * | 12/2004 | Sano | 473/324 |
| 6,852,041 | B1 * | 2/2005 | Huang | 473/342 |
| 6,884,388 | B2 * | 4/2005 | Ozaki et al. | 420/70 |
| 6,899,774 | B2 * | 5/2005 | Takayama et al. | 148/336 |
| 6,929,566 | B2 * | 8/2005 | Sano | 473/349 |
| 6,979,270 | B1 * | 12/2005 | Allen | 473/290 |
| 7,041,002 | B2 | 5/2006 | Yamamoto | |
| 7,078,107 | B2 * | 7/2006 | Takayama et al. | 428/553 |
| 7,086,963 | B1 * | 8/2006 | Onuki et al. | 473/342 |
| 7,273,584 | B2 * | 9/2007 | Ohtsuka et al. | 419/19 |
| 7,393,287 | B2 * | 7/2008 | Huang | 473/329 |
| 7,594,862 | B2 * | 9/2009 | Gilbert | 473/330 |
| 7,695,377 | B2 * | 4/2010 | Yamagishi et al. | 473/331 |
| 7,758,707 | B2 * | 7/2010 | Millward | 148/325 |
| 7,857,712 | B2 * | 12/2010 | Nishitani et al. | 473/342 |
| 7,878,923 | B2 * | 2/2011 | Yamagishi et al. | 473/330 |
| 8,088,025 | B2 * | 1/2012 | Wahl et al. | 473/346 |
| 2006/0128496 | A1 | 6/2006 | Weber et al. | |
| 2006/0137784 | A1 | 6/2006 | Lo | |
| 2008/0283162 | A1 | 11/2008 | Chiang | |

FOREIGN PATENT DOCUMENTS

| | | | |
|---|---|---|---|
| JP | 63206449 | A * | 8/1988 |
| JP | 04336083 | A * | 11/1992 |
| JP | 07299163 | A * | 11/1995 |
| JP | 08206260 | A * | 8/1996 |
| JP | 09056855 | A * | 3/1997 |
| JP | 2003113449 | | 4/2003 |
| JP | 2003113449 | A * | 4/2003 |
| JP | 2004321530 | | 11/2004 |
| JP | 2004321530 | A * | 11/2004 |
| JP | 2005298957 | | 10/2005 |
| JP | 2005298957 | A * | 10/2005 |
| JP | 2005319019 | A * | 11/2005 |
| JP | 2008069422 | | 3/2008 |
| JP | 2008069422 | A * | 3/2008 |
| WO | WO2010082685 | | 7/2010 |
| WO | WO 2010082685 | A1 * | 7/2010 |

* cited by examiner

HARDENED GOLF CLUB HEAD

CROSS-REFERENCE TO RELATED APPLICATION

The present application is a Continuation of U.S. application Ser. No. 12/490,666 filed Jun. 24, 2009 now U.S. Pat. No. 8,075,420; the disclosures of which is hereby incorporated by reference in their entirety.

FIELD OF THE INVENTION

The present invention relates to a hardened golf club head. More particularly, the present invention relates to a golf club head with a surface transformation that increases the hardness of the striking surface of the golf club head. Even more particularly, the present invention relates to a golf club head wherein the striking surface layer has been transformed into a martensitic crystalline structure to promote enhanced performance and durability.

BACKGROUND OF THE INVENTION

The present invention, although applicable towards various types of golf club heads, may generally be most applicable towards wedge type golf club heads due to their unique need to utilize the grooves for spin purposes. Wedge type golf club heads, more commonly known as wedges, are a particular type of golf club that generally has a high loft angle. These higher lofted wedges tend to be precision instruments that allow a golfer to dial in short range golf shots with improved trajectory, improved accuracy, and improved control. This increased loft angle in wedges generally yield a golf shot with a higher trajectory because the impact surface on the golf ball is not perpendicular to the trajectory of the club head; rather the golf ball interacts with the wedge at an inclination closely resembling the actual loft angle of the wedge itself. This inclination generally causes the golf ball to move up along the inclination of the wedge when struck by the wedge type golf club head, creating a backward rotation of the golf ball as it leaves the wedge club face. This backwards rotation of the golf ball may generally be known as "backspin" within the golf industry; and this backspin is desirable in helping improve trajectory, accuracy, and control of a golf shot using a wedge type golf club head.

Backspin helps improve trajectory, accuracy, and control of a golf shot by giving the golf ball a gyroscopic effect, which stabilizes trajectory, hence increasing accuracy. Moreover, backspin also serves to increase control of a golf shot as backspin minimizes the roll of a golf ball after landing, allowing a more predictability.

One of the ways to generate this desirable backspin is to increase the coefficient of friction between the wedge type golf club head and the golf ball. In order to achieve this higher coefficient of friction, wedge type golf club heads generally have horizontal grooves at the striking surface to catch the golf ball as it leaves the face of the club. It is well known in the art that the shape, depth, width, and geometry of the grooves on the striking surface of a wedge have a direct correlation with the amount of backspin on a golf ball.

In an attempt to increase the performance characteristics of a wedge type golf club, the grooves are getting sharper and more aggressive and creating more backspin. However, it is commonly known that these sharper and more aggressive grooves are more prone to wear over time. This wear is often caused by erosion that results from repeated impact between a golf ball and the wedge type golf club head. Moreover, this erosion process can be intensified when various other harsh abrasives such as soil and sand that could get caught between the wedge type golf club and a golf ball. Hence it can be seen that the wear and tear on the horizontal grooves of a wedge type golf club head may generally decrease the amount of backspin on a wedge type golf club head over time, leading to a decrease in its performance characteristics.

Many methods have been used to extend the life of a wedge type golf club head's grooves as well as the maintaining the striking face all while creating or maintaining a high coefficient of friction. Hard surfacing compounds have been plasma sprayed on the striking surface as one method to maintain performance and durability of the grooves on the striking surface of the wedge type golf club head. Alternatively, ball striking surface have also been carburized and nitrided in the past to minimize the wear and tear as well as creating a desired patina or coloration. Ceramic substances have also been flamed sprayed on the ball striking surface in the past to improve wear resistance and to create a desired coloration. Ball striking surfaces have also been sandblasted in addition to ion implantation techniques.

U.S. Pat. No. 4,768,787 to Shira titled Golf Club Including High Friction Striking Face ('787 patent), although more particularly directed towards an iron type golf club head, provides a more detailed example of a golf club with an improved striking surface wherein the striking surface has hard particles embedded therein with portions of the particles protruding above the surface so as to provide greater frictional grip between the golf ball striking surface and the golf ball. More specifically, the '787 patent discloses a club wherein the hard particles project or protrude slightly above the ball striking surface of the "iron" head and create friction between the club and the golf ball. Over an extended period of service, the matrix material will wear more rapidly than the hard particles, and the hard particles will continue to perform their friction creating function.

These approaches, although capable of providing a striking surface that has increase hardness and friction, require additional manufacturing processes that may be extensive and burdensome. Additionally, these approaches do not take advantage of the inherent material properties of a wedge type golf club head that is generally made out of carbon steel. Most importantly, methods such as the utilization hardened particles do not provide an even surface on the striking surface of the wedge, sacrificing performance properties in exchange for durability.

As indicated above, most of the modern wedges may generally be comprised of a carbon steel material that may have certain materials properties that lends itself well to heat transformation surface transformation. All of the above mentioned approaches to extending the performance characteristics of a wedge type golf club head do not utilize or take advantage of the inherent physical properties of the material from which the wedge type golf club head is made from. Martensitic crystalline layer may generally be achieved by heat treating the surface of a wedge that is comprised of carbon steel and rapidly quenching the wedge in a fluid to change the material properties of the heat treated surface.

Hence, it can be seen that there is a need in the field for a golf club head that has increased hardness on the striking surface. More specifically, there is a need for a wedge type golf club head that is capable of achieving an increased hardness on the striking surface without the need for additional surface treatments. Even more specifically, there is a need in the field for a wedge type golf club that utilizes the inherent crystalline composition structure of carbon steel to create a martensitic layer for improved hardness in the striking area.

BRIEF SUMMARY OF THE INVENTION

In one aspect of the present invention is a golf club head comprising of a body portion and a hosel extending from the body portion. The relationship of the body portion and the hosel help define a loft angle of the golf club head to be greater than about 45 degrees. The body portion of the golf club head may be further comprised of a striking face portion and a rear portion wherein the striking face portion has a thickness of less than about 2.0 mm and the striking face portion is comprised of a material having a martensitic crystalline structure.

In another aspect of the present invention is a method hardening a striking face portion of a golf club head comprising of heating the striking face portion of the golf club head to a target temperature and target duration. After the heating the striking face portion is rapidly quenched in a coolant to create a martensitic striking face portion. The golf club head may generally have a loft angle that is greater than about 45 degrees and the striking face portion may transform into a material having a martensitic crystalline structure.

In a further aspect of the present invention is a golf club head comprising of a body portion and a hosel extending from the body portion. The relationship of the body portion and the hosel help define a loft angle of the golf club head to be greater than about 45 degrees. The body portion of the golf club head may be further comprised of a striking face portion and a rear portion where the ratio of hardness of the striking face portion is greater than about 1.3 of the hardness of the rear portion defining a striking face hardness ratio.

These and other features, aspects and advantages of the present invention will become better understood with references to the following drawings, description and claims.

BRIEF DESCRIPTION OF DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features. However, any single inventive feature may not address any or all of the problems discussed above or may only address one of the problems discussed above. Further, one or more of the problems discussed above may not be fully addressed by any of the features described below.

The present invention generally provides a golf club head with a surface treatment that transformations and hardens of the striking surface portion of a golf club head. More specifically, the present invention relates to a wedge type golf club head made out of carbon steel that has a martensitic crystalline structure on the surface layer of the striking surface portion that enhances the strength of the wedge type golf club head as well as increase durability. The current invention is unlike the prior art golf clubs that utilizes additional additives or surface treatments that do not take advantage of the inherent performance characteristics within a wedge to maximize its performance.

Figure 1:
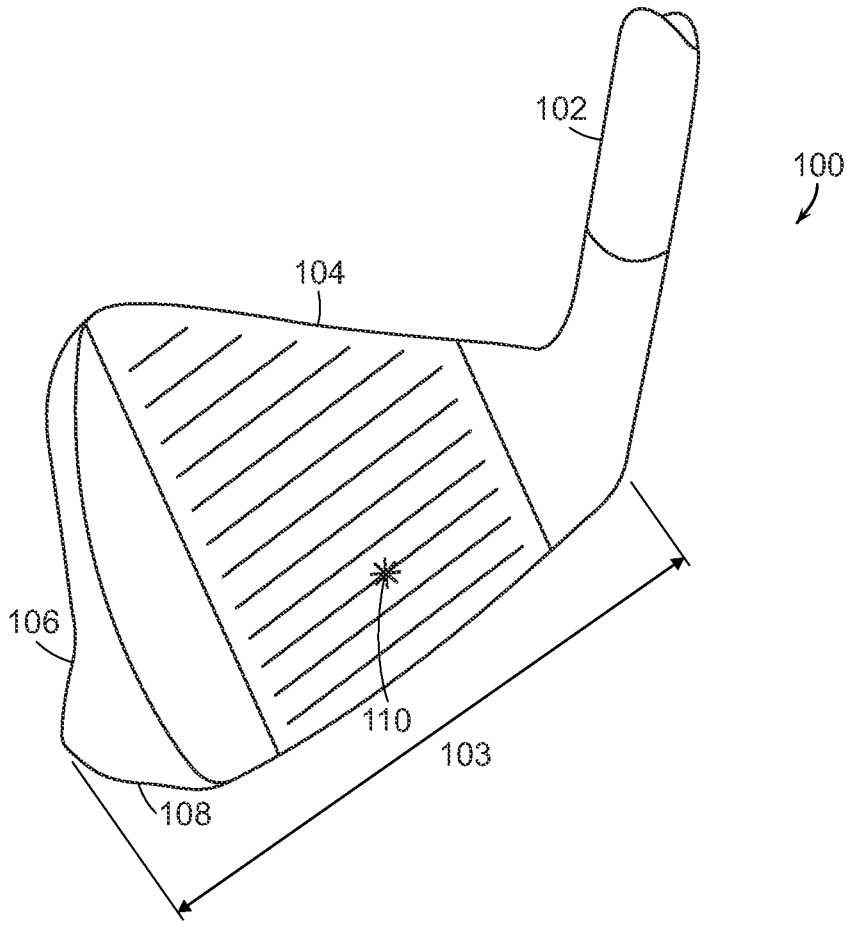
FIG. 1 shows a perspective view of a wedge type golf club head in accordance with an exemplary embodiment of the present invention.

FIG. 1 shows a perspective view of an exemplary embodiment of the present invention wherein the golf club head 100 is shown having a hosel 102 capable of connecting the golf club head 100 to a shaft (not shown). Golf club head 100, as shown in the current exemplary embodiment, may contain a body 103 that further comprises of a striking face portion 104 and a rear portion 106 that is separated by a sole 108 at the bottom of the golf club head 100. Finally, FIG. 1 may also show an impact point 110 located on the striking face portion of the golf club head 100 reflecting the general impact point between a golf club head 100 and a golf ball (not shown).

First and foremost, it should be noted that although the current invention is shown utilizing a wedge type golf club head 100, the current invention could be applicable to various other types of golf clubs such as iron type golf clubs or even driver type golf clubs without departing from the scope and content of the present invention. A wedge type golf club head 100 is used for illustration purposes here because a wedge type golf club head 100 may generally need to retain the shape of their sharp grooves in order to perform at creating spin. The present invention may be applicable to other types of clubs such as iron type golf club heads or even driver type golf club heads just as well as wedge type golf club head 100 without departing faun the scope and content of the present invention.

Golf club head 100, as shown in the current exemplary embodiment, may generally be made out of steel due to its inherent optimal high ductility, high strength, and soft feel characteristics. However, numerous other types of materials such as cast irons, gray irons, or even non-ferrous alloys may be used so long as it is capable of forming a golf club head 100 that can strike a golf ball all without departing from the scope and content of the present invention. More specifically, golf club head 100 may be generally be of a carbon steel type material such as low carbon steel, medium carbon steel, or high carbon steel. Even more specifically, golf club head 100 may generally be a medium carbon steel type material such as 8600 series steel, 9200 series steel, 6100 series steel, 5100 series steel, 4800 series steel, or any other type of medium carbon steel without departing from the scope and content of the present invention. Finally, golf club head 100 may most preferably be made out of cast 8620 steel due to the fact that it contains an optimal balance of all the desirable characteristics such as high ductility, high strength, soft feel, and its ability to transform into a martensitic crystalline metal.

Hosel 102, as shown in the current exemplary embodiment, may generally be comprised of the same material as the remainder of the golf type club head 100. Having the hosel 102 be comprised out of a ductile material such as cast 8620 steel may be advantageous in allowing the hosel 102 to be bent to a different position allowing for loft and lie adjustment of the wedge; however numerous other materials may also be used to form the hosel 102 of the golf club head 100 even if it is not the same material as the remainder of the golf club head 100 without departing from the scope and content of the present invention. Golf club head 100, including hosel 102 may generally be comprised of a unitary material such as the medium carbon steel of the 8620 class in order to maintain consistency. However, hosel 102 of the golf club head 100 may be comprised of a completely different material to differentiate the look and feel of the golf club head 100 all without departing from the scope and content of the present invention.

Connected distally to the hosel 102 at the bottom of the golf club head 100 is the body 103 portion. Body 103, as shown in the current exemplary embodiment, may generally also be made out of the same ductile material such as cast 8620 steel mentioned above. The ductility of 8620 steel, despite being advantageous in being easily bendable in the hosel 102, also provide a soft feel to the golf club head 100 upon impact. However, body 103 of the golf club head 100 may also be of a different material such as stainless steel, cast irons, gray irons, or even non-ferrous alloys so long as it is capable of forming a golf club head 100.

Body 103, as shown in FIG. 1, may generally be further identified as containing a striking face portion 104 and a rear portion 106. Striking face portion 104 may generally include a frontal layer of the golf club head 100, including the striking surface of the golf club head 100, upon which a ball impacts a golf ball. Striking face portion 104, as shown in the current exemplary embodiment, may more specifically be comprised of a martensitic layer that contains a martensitic crystalline structure with an increased hardness when compared to the hardness of the rear portion 106 of the golf club head 100. Having a martensitic layered striking face portion 104 may generally increase the performance characteristics of a golf club head 100 by maintaining the shape of the grooves for a longer period of time and preserving spin characteristics while preserving the soft feel around the remainder of the golf club head 100.

Martensitic striking face portion 104, as shown in the current exemplary embodiment, may generally be formed by heating the striking face portion 104 of the golf club head 100 utilizing a flame and then immediately quenching the striking face portion 104 of the golf club head 100 into a coolant. This methodology of creating a martensitic striking face portion 104 may result in a striking face portion 104 having an increased hardness while preserving the ductility of the remainder of the golf club head 100. Having ductility in the hosel 102 may generally allow more bending of the hosel 102, while having ductility within the rear portion 106 of the golf club head 100 increases softness and feel for the golf club head 100.

It should be noted that the heating process described above should generally be performed utilizing a centralized flame source located at the impact point 110 of the striking face portion 104 of the golf club head 100. Utilizing a centralized flame source located at the impact point 110 will allow the martensitic transformation of the striking face portion 104 of the golf club head 100 without affecting the hardness of the remainder of the golf club head 100 such as the hosel 102 and the rear portion 106. Moreover centralizing and focusing the flame source at the impact point 110 may allow a hardness gradient within the striking face portion 104 of the golf club head 100, yielding the hardest point at the impact point 110, and a gradual decrease of hardness as the distance gets further apart from the impact point 110. (see FIGS. 6 and 7) Although it may be desirable to have the hardest point located at the impact point 110 of the golf club head 100, the flame could be centralized at any other location within the striking face portion 104, or even evenly distributed across the entire striking face portion 104 so long as it creates a martensitic layer all without departing from the scope and content of the present invention.

Alternatively, the striking face portion 104 may be heated utilizing an induction method wherein the striking face portion 104 may be heated by electromagnetic induction where the eddy currents are generated within the metal and resistance leads to joule heating of the striking face portion 104. More specifically, the striking face portion 104 of the golf club head 100 may be connected to an AC power supply that provides electricity with a low voltage along with a high current and high frequency wherein the striking face portion 104 may be placed inside an air coil driver by the power supply. Once the striking face portion 104 of the golf club head 100 reaches the desired temperature, the striking face portion 104 may be quenched in a liquid coolant such as water. This cooling process may be either concentrated at the striking face portion 104 or it may occur through the entire golf club head 100 all without departing from the scope and content of the present invention. Ultimately, after striking face portion 104 of the golf club head 100 has been cooled, the striking face portion 104 may yield a hardened martensitic striking face portion 104 with more uniformity and more controlled results.

In order to achieve a martensitic striking face portion 104, the golf club head 100 needs to be heated to a desired temperature. The desired temperature may vary depending on the speed of cooling but may generally be greater than about 600 degrees Celsius, more preferably greater than about degrees 700 Celsius, and most preferably greater than about 800 degrees Celsius. Additionally, the cooling rate of the golf club head 100 may also be another important factor that needs to be controlled in order to generate a martensitic striking face portion 104. The cooling rate needs to happen rapidly at a rate of greater than about 1,000 degrees Celsius per second, more preferably greater than about 2,500 degrees Celsius per second, and most preferably greater than 5,000 degrees Celsius per second. Finally, it is also worth noting that the above mentioned heating and cooling methods may generally be applicable towards the striking face portion 104 of the wedge type golf club head 100. Other methods such as tempering may be used to relax or soften the rear portion 106 while maintaining the hardness of the striking face portion without departing from the scope and content of the present invention.

Figure 2:
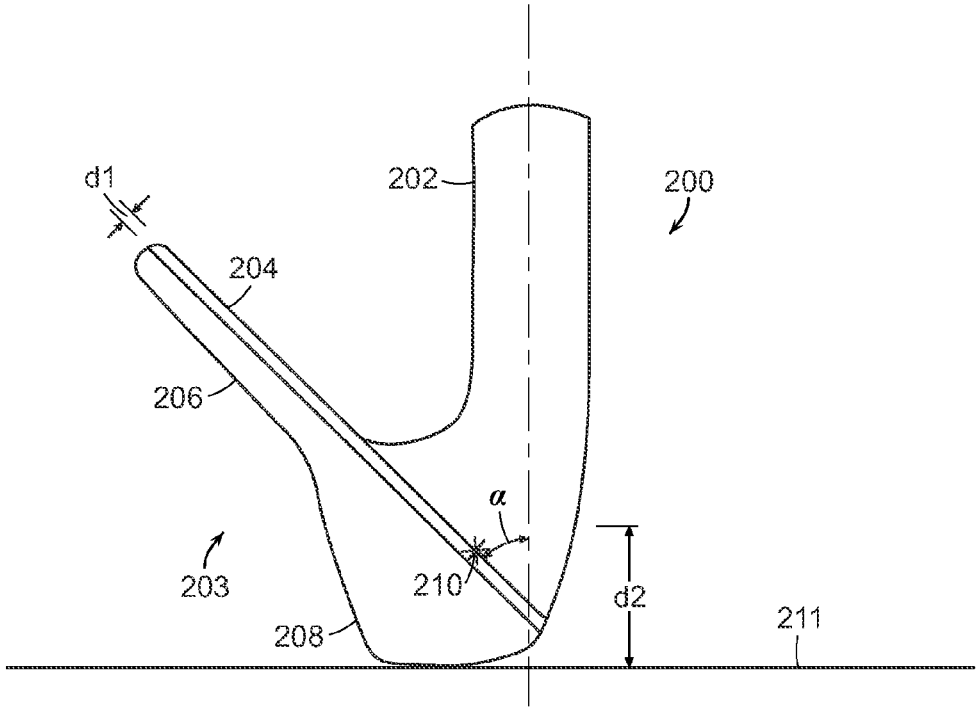
FIG. 2 shows a side view of a wedge type golf club head in accordance with an exemplary embodiment of the present invention.

Turning now to FIG. 2, which shows a side view of an exemplary embodiment of the present invention capable of showing the height and location of the impact point 110 in FIG. 1 in more detail being depicted as impact point 210. Impact point 210, as shown in this exemplary embodiment of the present invention, may generally be located on the striking face portion 204 of the golf club head 200; reflective of the common location of impact between the golf club head 200 and a golf ball (not shown). Impact point 210, may generally be at a distance d2 away from the ground 211 along the vertical direction. This distance d2 may be from about 10 mm to about 20 mm from ground 211, more preferably a distance of from about 12 mm to about 18 mm from ground 211, and more preferably a distance of about 15 mm from ground 211.

FIG. 2 also shows the thickness of the striking face portion 204 of the wedge type golf club had 200 having a thickness distance d1. Thickness distance d1, as shown in the current exemplary embodiment, represents the amount of martensitic layered face portion 204 within the golf club head 200. Thickness distance d1 of the striking face portion 204 may generally be less than about 2 mm, more preferably less than about 1.5 mm, most preferably less than about 1.25 mm. The thickness distance d1, although shown in FIG. 2 as a having constant thickness, may also take the form of a variable thickness due to the natural transformation of the carbon steel wedge depending on the temperature of the heat source, the length of heat treatment, and the quenching process without departing from the scope and content of the present invention.

The hardness of the striking face portion 204, in accordance with an exemplary embodiment of the present invention may generally be greater than about 300 VH1 (Vickers Hardness Scale using 1 kg load) due to the martensitic crystalline structure. However, it may be more preferable to have the hardness of the striking face portion 204 be greater than about 350 VH1 and most preferably be greater than about 400 VH1 in order to create a sufficiently hard and durable striking face portion 204. The hardness of the rear portion 206, may generally be less than about 250 VH1 that is similar to the natural hardness of medium carbon steel such as 8620 steel. However, hardness of the rear portion may be less than about 200 VH1, or even less than about 175 VH1 to promote a soft feel for the golf club head without departing from the scope and content of the present invention.

Golf club head 200, depending on the hardness of the striking face portion 204 and the hardness of the rear portion 206, may generally have a "striking face hardness ratio" of greater than about 1.3 to yield a striking face portion 204 that is harder than the rear portion 206. "Striking face hardness ratio", as defined in the current invention, may generally be a ratio of the hardness of the striking face portion 204 divided by the hardness of the rear portion 206 yielding an equation shown below as equation (1).

$$\text{Striking Face Hardness Ratio} = \frac{\text{Hardness of Striking face portion 204}}{\text{Hardness of Rear Portion 206}} \quad \text{Eq. (1)}$$

However, a golf club head 200 in accordance with the present invention may have a "striking face hardness ratio" that is greater than about 1.5, or even greater than about 2.0 all without departing from the scope and content of the present invention.

Golf club head 200, as shown in FIG. 2, may generally have a higher loft angle $\alpha$ to allow for greater shot control and precision. Here, in the current exemplary embodiment, loft angle $\alpha$ may generally be greater than about 45 degrees, more preferably greater than about 46 degrees, and most preferably greater than about 48 degrees. However, a golf club head 200 in accordance with the present invention having a martensitic striking face portion 204 layer may be applicable towards all types of golf clubs including irons, putters, or even drivers so long as the golf club could benefit from a hardened striking surface.

Figure 3:
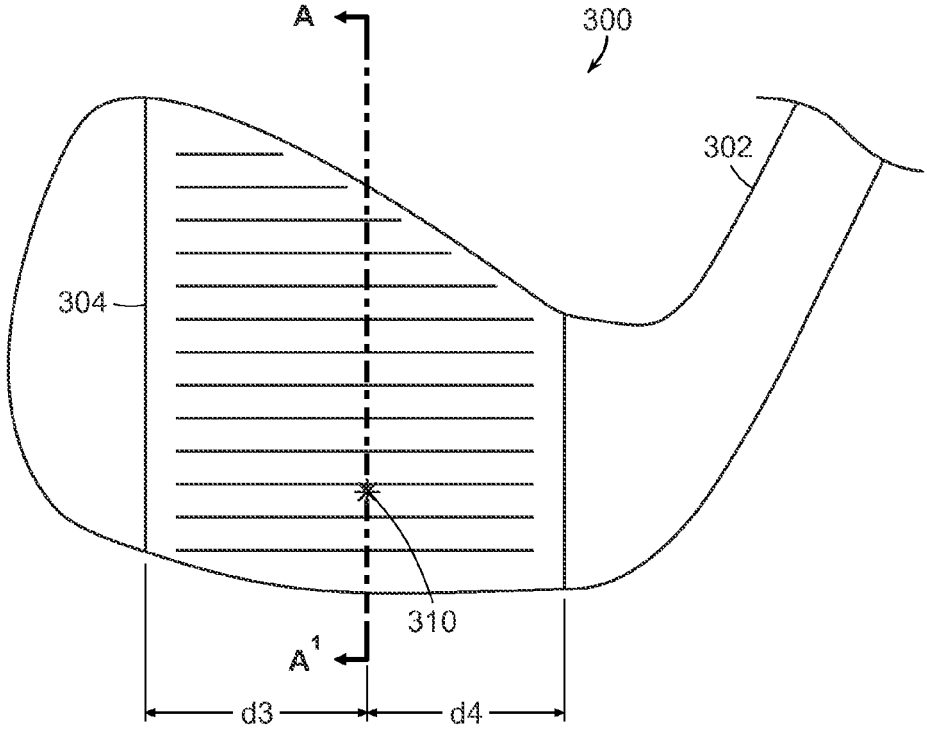
FIG. 3 shows a frontal view of a wedge type golf club head in accordance with an exemplary embodiment of the present invention.

Turning now to FIG. 3 showing a front view of a golf club head 300 in accordance with an exemplary embodiment of the present invention showing the location of the impact point 310 horizontally along the striking face portion 304 of the golf club head 300. Impact point 310, as shown in the current exemplary embodiment, may generally be located at the horizontal center of the striking face portion 304 wherein the distance d3 is equal to distance d4. Impact point 310, as shown in the current exemplary embodiment may generally depict the most common location that a golf club head 300 strikes a golf ball (not shown). However, it should be noted that impact point 310 may also be located off center within the striking surface of the striking face portion 304 wherein d3 may be greater than d4, or even where d4 may be greater than d3 without departing from the scope and content of the present invention.

Figure 4A:
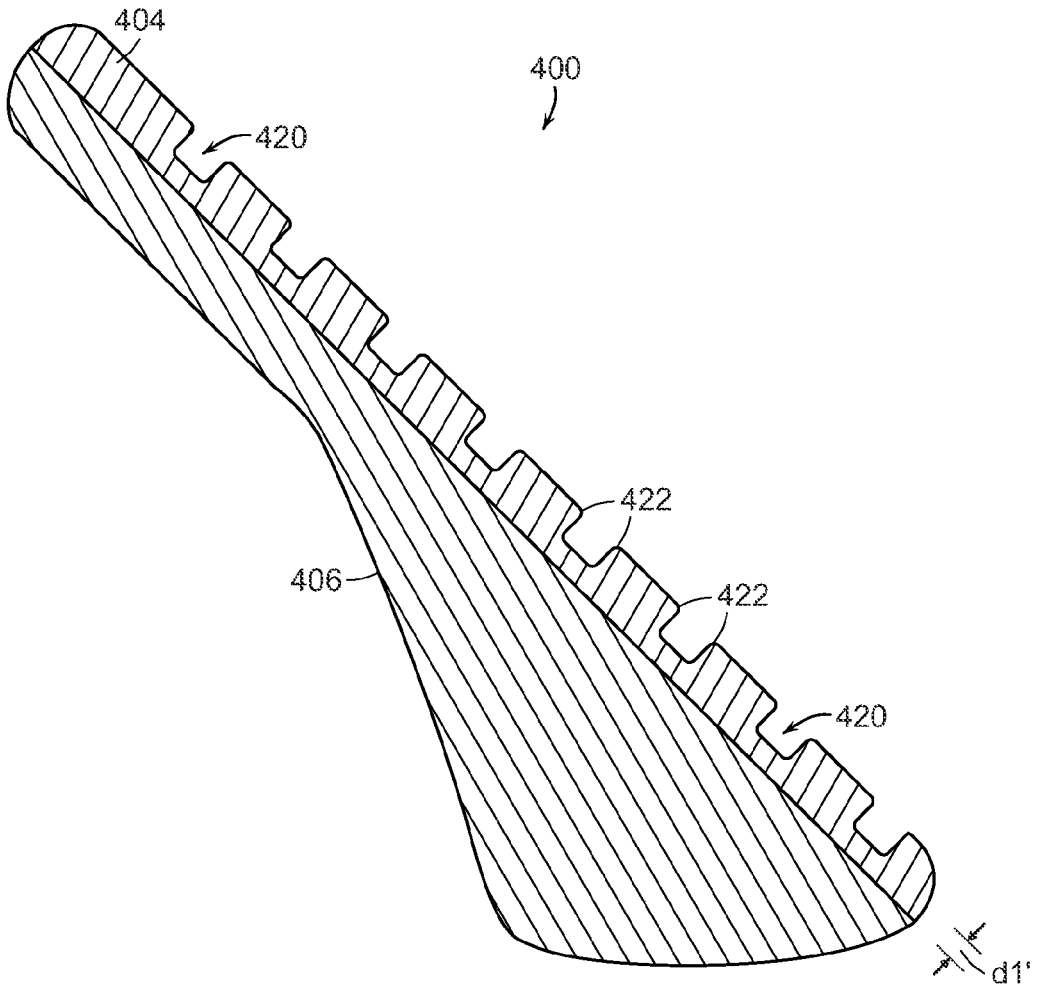
FIG. 4*a* shows a cross-sectional view of a wedge type golf club head in accordance with an exemplary embodiment of the present invention taken along cross-sectional line A-A' as shown in FIG. 3.
Figure 4B:
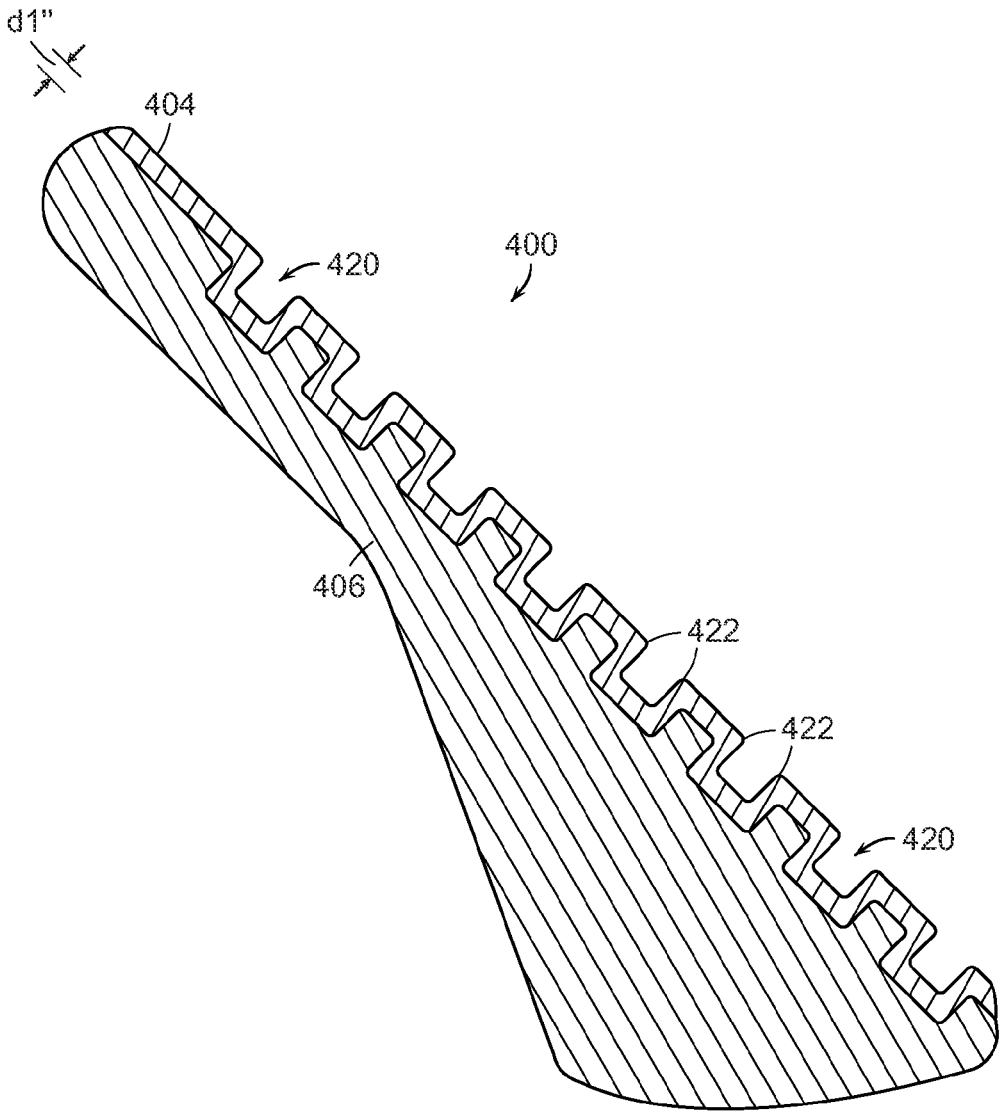
FIG. 4*b* shows a cross-sectional view of a wedge type golf club head in accordance with an exemplary embodiment of the present invention taken along cross-sectional line A-A' as shown in FIG. 3.

FIG. 4*a* and FIG. 4*b* show two cross-sectional views of a golf club head 400 in accordance with two different exemplary embodiments of the present invention taken along cross-sectional line A-A' as shown in FIG. 3. FIG. 4*a* and FIG. 4*b* differ from one another only in the thickness profiles of the striking face portion 404 containing hardened martensitic crystalline structure. The thickness d1 of the striking face portion 404 as shown in FIG. 4*a* may varying from d1 to d1' on whether the striking face portion 404 contains a groove 420 or not. This variable thickness of the striking face portion 404 may generally be the result of machining the plurality of grooves 420 after the striking face portion 404 has received the heat treatment that creates the martensitic crystalline structure. Having this variable thickness of the striking face portion 404 may be desirable in maintaining the dimensions of the pluralities of grooves 420, as heat treatment of the striking face portion 404 could alter the dimensions of such grooves 420.

On the other hand, the thickness d11 of the striking face portion 404 as shown in FIG. 4*b* may have a constant thickness following the geometry of the plurality of grooves 420. This constant thickness d11 of the striking face portion may generally be a result of heat treating the striking face portion 404 after the grooves 404 have already been machines into the striking face portion 404 of the golf club head 400. Having this constant variable thickness may generally be desirable in the current inventive golf club head 400 as it provides a more uniform hardened surface resulting in a more constant feel across the entire striking face portion 404 of the golf club head 400. However, it should be noted that the dimensions of the plurality of grooves 420 could be altered due to the heat treatment process creating the martensitic crystalline structure, which could be an undesirable result if such changes in the dimensions exceed the usual dimensional tolerances of the plurality of grooves.

The cross-sectional view of the golf club head 400 shown in FIG. 4*a* and FIG. 4*b* both allow a clearer view of the grooves 420 in accordance with an embodiment of the present invention. Grooves 420, as shown in the current exemplary embodiment, may generally be part of the striking face portion 404 of the golf club head 400, and may generally be considered part of the martensitic layer having a body centered martensitic crystalline structure that results in an increased hardness. These hardened grooves 420 may generally be more resistant to wear due to the martensitic crystalline structure, and will be able to resist deterioration that could result in decreased performance characteristics such as spin rate.

It should also be noted that the golf club head 400, as shown in FIG. 4*a* and FIG. 4*b* may also have a variable hardness distribution even within the striking face portion 404 of the golf club head 400. More specifically, the striking face portion 404 of the golf club head 400 may have an increased hardness at the corners 422 of the grooves 420 resulting from improved martensitic crystalline transformation. The increased hardness of the corners 422 of the grooves 420 may result from geometry of the grooves trapping heat at the corners 422 above causing the corners 422 to be hotter, resulting in a harder corner 422 after it is quenched. It should be noted that the grooves 420 may take on various shapes to yield a different radius or curvature at the corners that may or may not have an increased hardness without departing from the scope and content of the present invention so long as the plurality of grooves 422 has been transformed into a martensitic striking face portion 404 with an increased hardness.

Figure 5:
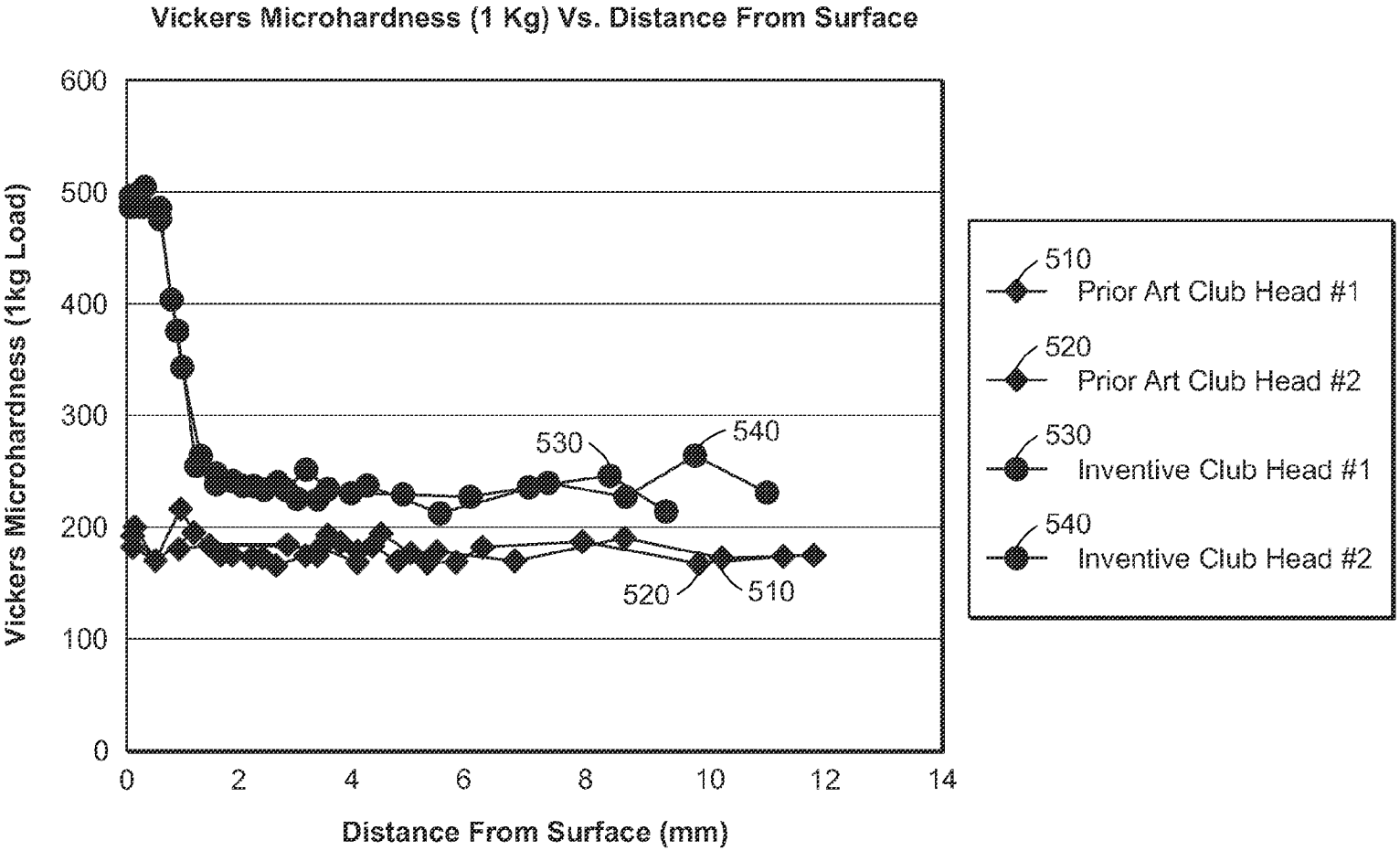
FIG. 5 shows a graphical representation of the hardness profile of the wedge type golf club head.

FIG. 5 shows a hardness profile of a golf club head 530 and 540 taken along the depth of the golf club head 530 and 540 plotted against a prior art club head 510 and 520. As we can see in FIG. 5, the hardness of the a golf club head 530 and 540 in accordance with the present invention, may generally be harder near the surface of the golf club head 530 and 540, and rapidly decreases as it shifts away from the hitting surface for an approximate thickness distance of about 2.0 mm. This rapidly decreasing slope may generally be greater than about −100 VH1/mm, more preferably greater than about −150 VH1/mm, and most preferably greater than about −175 VH1/mm. After the initial 2.0 mm thick face portion, the hardness of the rear portion of the inventive golf club head 530 and 540 may generally plateau off after the initial rapidly decreasing slope to a constant hardness similar to that of a prior art club head 510 and 520.

Figure 6:
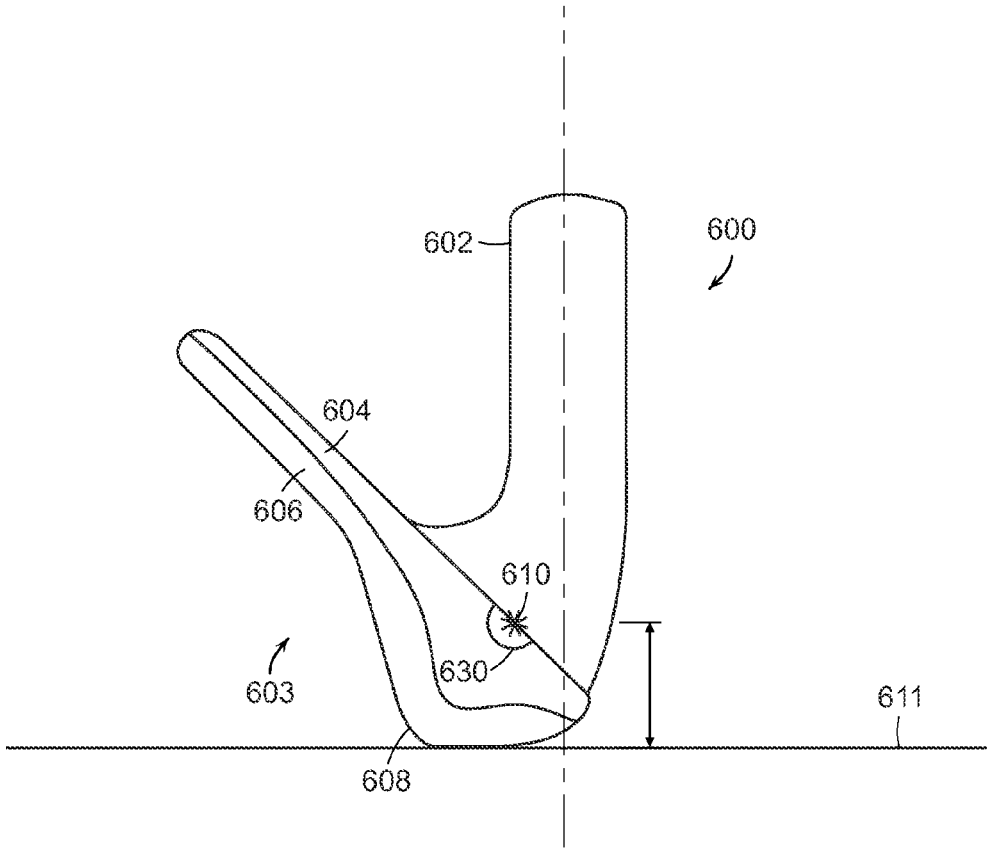
FIG. 6 shows a side view of a wedge type golf club head in accordance with an alternative embodiment of the present invention.

FIG. 6 shows the a side view of an alternative embodiment of the present invention wherein the golf club head 600 may have a different striking face portion 604 profile to reflect an alternative martensitic layer profile. This different striking face portion 604 profile, as shown in this current alternative embodiment, may generally have an increased thickness behind the impact point 610 that results from a concentrated heat source at the impact point 610. Concentrated heat source at impact point 610 may generally create the hottest temperature at the impact point 610, and a gradual drop in temperature away from the striking face portion 604. The concentrated hear source at the impact point 610 may generally result in a thicker martensitic striking face portion 604 behind the impact point 610 and a gradually decreasing martensitic portion thickness moving away from the impact point 610 as shown in FIG. 6. The increased thickness of the martensitic striking face portion 604 as shown in the current exemplary embodiment may not only serve to increase durability of the grooves of the golf club head 600, but could also serve to increase performance characteristics of a golf ball hit by the golf club head 600 having an increased thickness of martensitic layer behind the impact point 610.

In order to achieve this variable thickness profile of martensitic crystalline structure profile at the striking face portion 604, a heat sink 630 may be added behind the impact point 610 to allow for an even more concentrated heat location behind the impact point 610 to create a dramatic variable thickness profile of the martensitic crystalline structure at the striking face portion 604 of the golf club head 600. However, it should be noted that such a variable thickness profile may be created without a heat sink 630, and may result naturally from a concentrated heat source alone without departing from the scope and content of the present invention.

Figure 7:
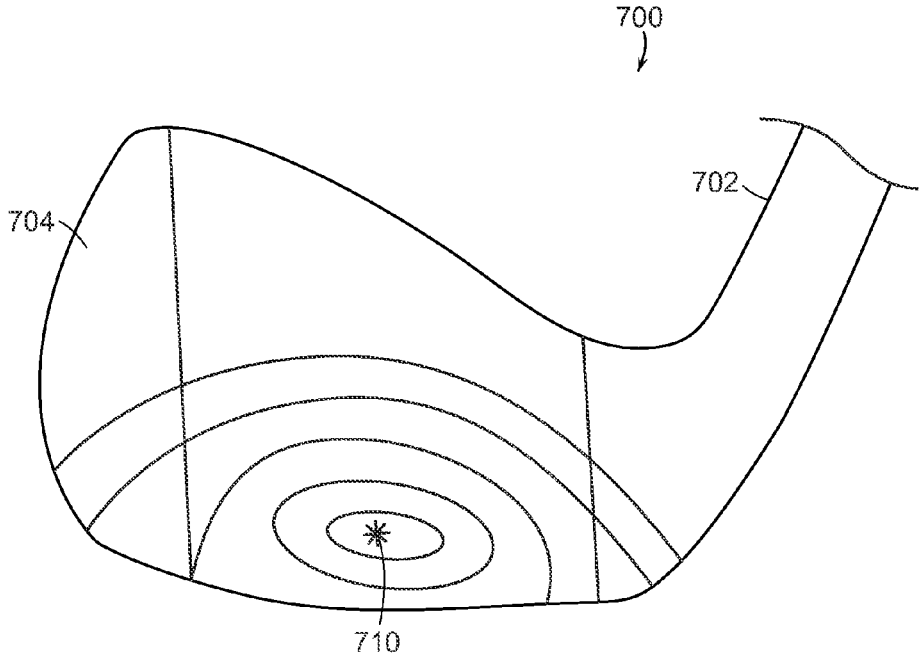
FIG. 7 shows a frontal view of a wedge type golf club head in accordance with an exemplary embodiment of the present invention showing the hardness distribution profile.

Turning now to FIG. 7, showing a frontal view of a golf club head 700 in accordance with an alternative embodiment of the present invention showing a gradual radial decrease in hardness level of the martensitic striking face portion 704 as it travels horizontally away from the impact point 710. More specifically, the golf club head 700 shown in FIG. 7 may have a concentrated heat source at the impact point 710 and may generally yield a martensitic striking face portion 704 having a bulls-eye shape with decreasing hardness profile moving away from the impact point 710. Impact point 710, as indicated above, may generally be the location of the concentrated heat source, hence creating the hottest location on the striking face portion 704. When the golf club head 700 is cooled after the golf club head 700 is removed from the heat source, the hottest portion on the striking face portion 704 may have the best transformation into a martensitic crystalline structure, yielding the hardest point on the striking face portion 704. As the temperature decreases radially away from the impact point 710, the transformation of the carbon steel to a martensitic crystalline structure decreases, yielding more pearlite and less martensitic crystalline, making those areas softer when compared to the impact point 710.

Figure 8:
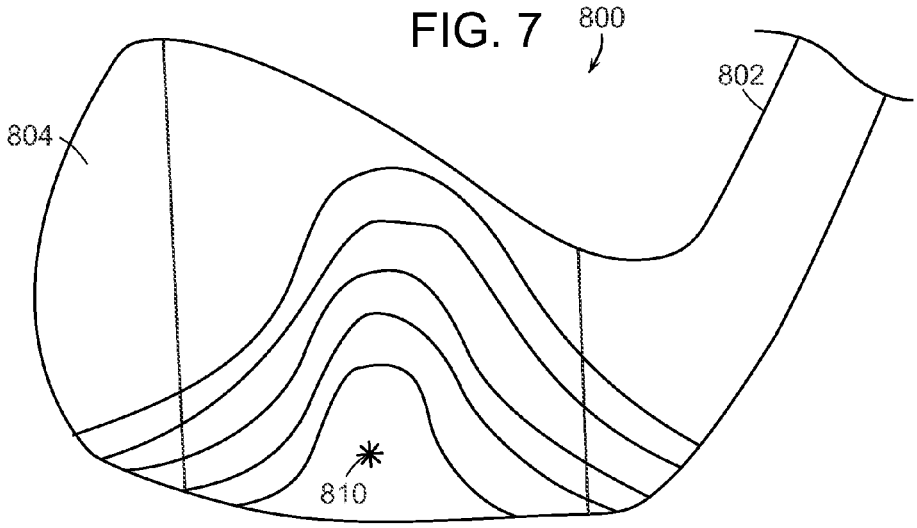
FIG. 8 shows a frontal view of a wedge type golf club head in accordance with an alternative embodiment of the present invention showing the hardness distribution profile.

FIG. 8 shows a different frontal view of a golf club head 800 in accordance with a further embodiment of the present invention wherein the striking face portion 804 has a different radially decreasing hardness profile. More specifically, striking face portion 804 may have a bell curve shaped profile of decreasing hardness profile while having the impact point 810 being the hardest point within the striking face portion 804 of the golf club head 800. It should be noted that FIGS. 7 and 8 are merely illustrations of various variable hardness profiles that could result from the various heating techniques, and numerous other variable face hardness profile may be used without departing from the scope and content of the present invention so long as the various embodiments creates a martensitic striking face portion.

Figure 9:
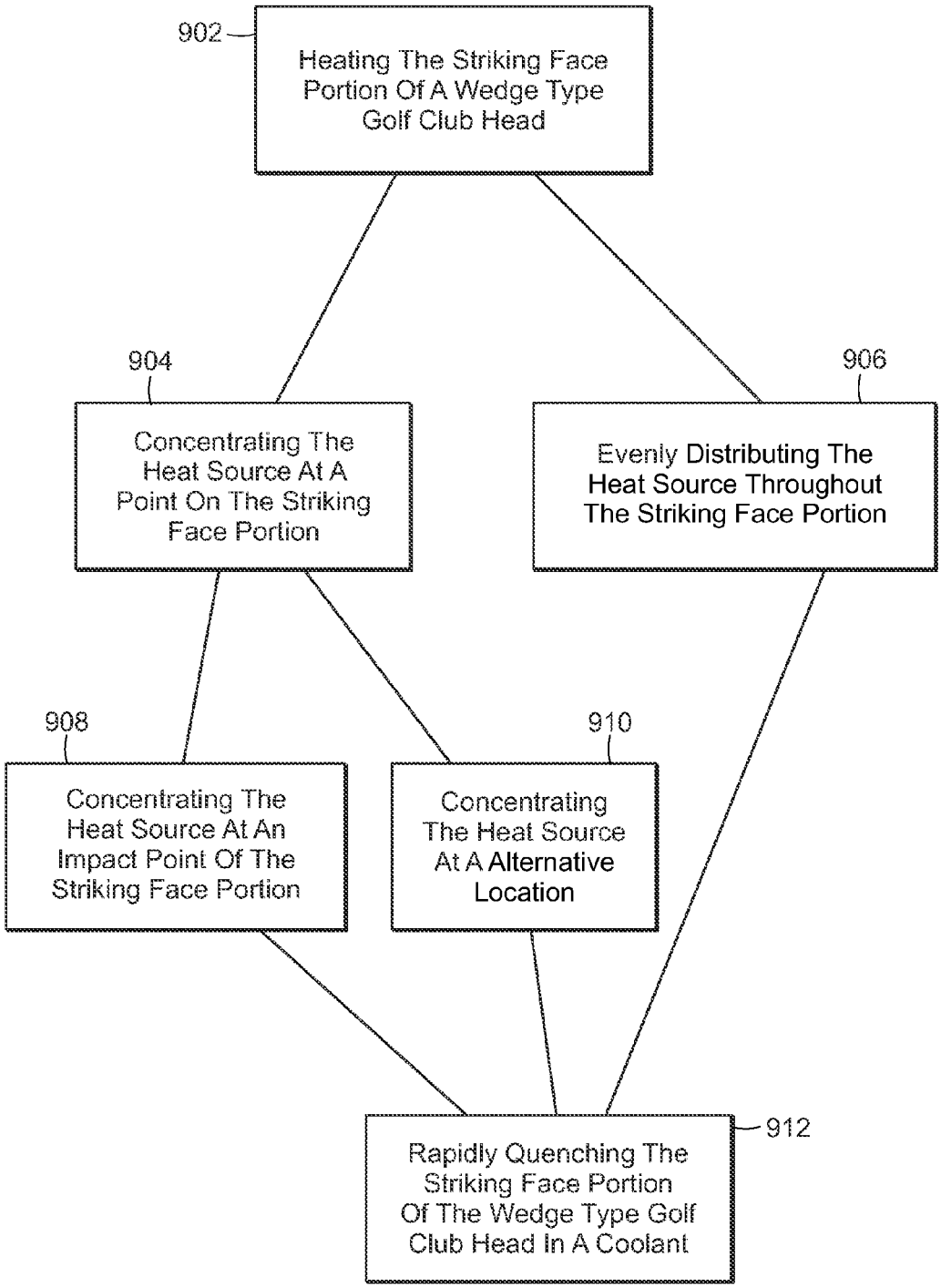
FIG. 9 shows a block diagram of a method of creating a wedge type golf club head having a hardened striking face portion.

FIG. 9 shows a flow chart indicating a method of hardening a striking face portion of a golf club head in accordance with an exemplary embodiment of the present invention. At step 902 the striking face portion of the present invention is heated up utilizing a heat source. Heat sources, as used in a present invention, may generally be a flame torch, however numerous other heating methods using conduction, convection, or even radiation may be used without departing from the scope and content of the present invention. Heating of the striking face portion could either be concentrated at a point on the striking face portion as indicated in step 9804, or could be evenly distributed throughout the striking face portion as indicated in step 906. If the heating of the striking face portion is concentrated on a point, it could either be concentrated at an impact point as indicated in step 908, or at any other alternative point on the striking face portion as indicated in step 910 without departing from the scope and content of the present invention. Regardless of how the striking face portion was heated, the golf club head may be rapidly quenched in a coolant as described in step 912 without departing from the scope and content of the present invention.

Other than in the operating examples, or unless otherwise expressly specified, all of the numerical ranges, amounts, values and percentages such as those for amounts of materials, moment of inertias, center of gravity locations, loft and draft angles, hardness ranges, and others in the afore mentioned portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. A golf club head comprising:

a body portion; and a hosel extending from said body wherein a relationship between said body portion and said hosel defines a loft angle;

wherein said loft angle is greater than about 45 degrees;

wherein said body portion comprises a striking face portion and a rear portion;

wherein said striking face portion has a thickness of less than about 2.0 mm at an impact point, said impact point defined as a point that bisection the scoreline in a lengthwise direction at a point 15 mm above a ground plane, wherein at least said impact point of said striking face portion has a martensitic crystalline structure;

wherein said impact point of said striking face portion has a striking face hardness ratio of greater than about 1.3, and wherein said striking face hardness ratio is defined by a hardness of said striking face portion at said impact point divided by a hardness of said rear portion.

2. The golf club head of claim 1, wherein said hardness of said striking face portion is greater than about 300 VH1.

3. The golf club head of claim 2, wherein said hardness of said striking face portion is greater than about 400 VH1.

4. The golf club head of claim 1, wherein said body portion is comprised at most about 2 wt. % of C, at most about 5 wt. % of non-carbon additions, and the remainder being substantially Fe.

5. The golf club head of claim 1, wherein said golf club head is comprised of a carbon steel material.

6. The golf club head of claim 1, wherein said impact point is the hardest point on said striking face, and wherein said striking face portion has a variable hardness decreasing inversely as the distance away from the impact point increases radially.

7. The golf club head of claim 1, wherein said hardness of said striking face portion decreases at a gradual slope from said impact point to a point of about 2.0 mm deep inside the striking face portion of said golf club head.

8. The golf club head of claim 7, wherein said gradually decreasing slope is about 150 VH1/mm.

9. A golf club head comprising a body portion, and a hosel;

wherein said body portion comprises a striking face portion and a rear portion;

wherein said striking face portion comprises a material having a martensitic crystalline structure, wherein said hardness of said striking face is greater than about 400 VH;

wherein said golf club head is comprised of a carbon steel material; and wherein said golf club head has a striking face hardness ratio of greater than 1.3; said striking face hardness ratio defined by a hardness of said striking face portion divided by a hardness of said rear portion.

10. The golf club head of claim 9, wherein said impact point is the hardest point on said striking face, and wherein said striking face portion has a variable hardness decreasing inversely as the distance away from the impact point increases radially.

11. The golf club head of claim 9, wherein said hardness of said striking face portion decreases at a gradual slope from said impact point to a point of about 2.0 mm deep inside the striking face portion of said golf club head.

12. The golf club head of claim 11, wherein said gradually decreasing slope is about 150 VH1/mm.

13. A golf club head comprising:

a body portion; and a hosel;

wherein said body portion comprises a striking face portion and a rear portion;

wherein said striking face portion comprises a material having a martensitic crystalline structure, wherein said hardness of said striking face portion is greater than a hardness of said body portion, and wherein said golf club head has a striking face hardness ratio of greater than about 1.3; said striking face hardness ratio defined by a hardness of said striking face portion divided by a hardness of said rear portion.

14. The golf club head of claim 13, wherein said golf club head is comprised of a carbon steel material.

* * * * *